US005788587A

United States Patent [19]

Tseng

[11] Patent Number: 5,788,587

[45] Date of Patent: Aug. 4, 1998

[54] CENTROID-ADJUSTABLE GOLF CLUB HEAD

[76] Inventor: Wen-Cheng Tseng, No. 27, Kung Chuan Rd., Tai Shan Hsiang, Taipei Hsien, Taiwan

[21] Appl. No.: 888,918

[22] Filed: Jul. 7, 1997

[51] Int. Cl.[6] ..... A63B 53/04

[52] U.S. Cl. ..... 473/326; 473/329; 473/332; 473/333

[58] Field of Search ..... 473/324, 326, 473/328, 332, 333, 345, 349, 350, 256, 291, 329

[56] References Cited

U.S. PATENT DOCUMENTS

| | | | |
|---|---|---|---|
| 3,817,522 | 6/1974 | Simmons . | |
| 5,064,197 | 11/1991 | Eddy . | |
| 5,195,747 | 3/1993 | Choy | 473/333 |
| 5,410,798 | 5/1995 | Lo et al. . | |

FOREIGN PATENT DOCUMENTS

| | | | |
|---|---|---|---|
| 124401 | 5/1947 | Australia | 273/78 |
| 24274 | 11/1898 | United Kingdom | 273/78 |

*Primary Examiner*—Sebastiano Passaniti
*Attorney, Agent, or Firm*—Parkhurst & Wendel L.L.P.

[57] ABSTRACT

A centroid-adjustable golf club head, which can enable a user to strike ball more stably and accurately, is disclosed. The centroid-adjustable golf club head includes a head body, a sphericity, a floating ball and liquid with large specific weight. The head body has anti vibration and thermoplastic elastomer disposed therein and defines a screw hole at a top thereof. The sphericity is disposed in the anti vibration and thermoplastic elastomer of the head body. The sphericity has a charging spout formed on a top thereof and aligned with the screw hole of the head body; and a elastic wafer disposed between the head body and the sphericity. The floating ball is disposed in the sphericity. The liquid with large specific weight is fed from the charging spout to the sphericity. With this arrangement, the centroid of the club head can be adjusted to an appropriate position, depending to the relative position of the liquid and the floating ball. Therefore, the user can strike the ball stably in any time and by any angle.

5 Claims, 5 Drawing Sheets

CENTROID-ADJUSTABLE GOLF CLUB HEAD

BACKGROUND OF THE INVENTION

1. Field of the Invention

The present invention relates to a golf club head, and more particularly to a centroid-adjustable golf club head which can enable a user to strike a ball more stably.

2. Description of Related Art

Golf is one of the most popular sporting activities nowadays. Every golf enthusiast knows that selecting a high-quality golf club is very important to obtain an accuracy and stability of striking. In early times, some manufacturers produce a golf club with a level-meter mounted on the club head so that a beginner can learn the levelness of his operation. For an experienced enthusiast, the manufacturers produce a golf club added with heavy objects to improve the stability of striking by lowering a centroid of the club head. This kind of golf club has an disadvantage that the centroid can not be adjusted when the user wields the club to strike ball from different angles, because the additional heavy object is securely located on the club head and the centroid position thereof is always rigid.

The present invention provides an improved centroid-adjustable golf club head to mitigate and/or obviate the aforementioned problems.

SUMMARY OF THE INVENTION

One object of the present invention is to provide a centroid-adjustable golf club head which enables a user to strike a ball more stably and accurately.

In accordance with one aspect of the present invention, a centroid-adjustable golf club head includes a head body, a sphericity, a floating ball and liquid with large specific weight. The head body has anti vibration and thermoplastic elastomer disposed therein and defines a screw hole at a top thereof. The sphericity is disposed in the anti vibration and thermoplastic elastomer of the head body. The sphericity has a charging spout formed on a top thereof and aligned with the screw hole of the head body; and a elastic wafer disposed between the head body and the sphericity. The floating ball is disposed in the sphericity. The liquid with large specific weight is fed from the charging spout to the sphericity.

In accordance with another aspect of the present invention, the head body further has a cover threaded into the screw hole.

In accordance with a further aspect of the present invention, the sphericity further has a steel ball filled in the charging spout for water-seal.

In accordance with still a further aspect of the present invention, the charging spout is sealed by seal gum.

In accordance with still a further aspect of the present invention, the floating ball has an outer layer of heat-resistant resin with high strength enclosing the anti vibration and thermoplastic elastomer thereof.

Other objects, advantages and novel features of the invention will become more apparent from the following detailed description when taken in conjunction with the accompanying drawings.

DETAILED DESCRIPTION OF PREFERRED EMBODIMENT

Figure 1:
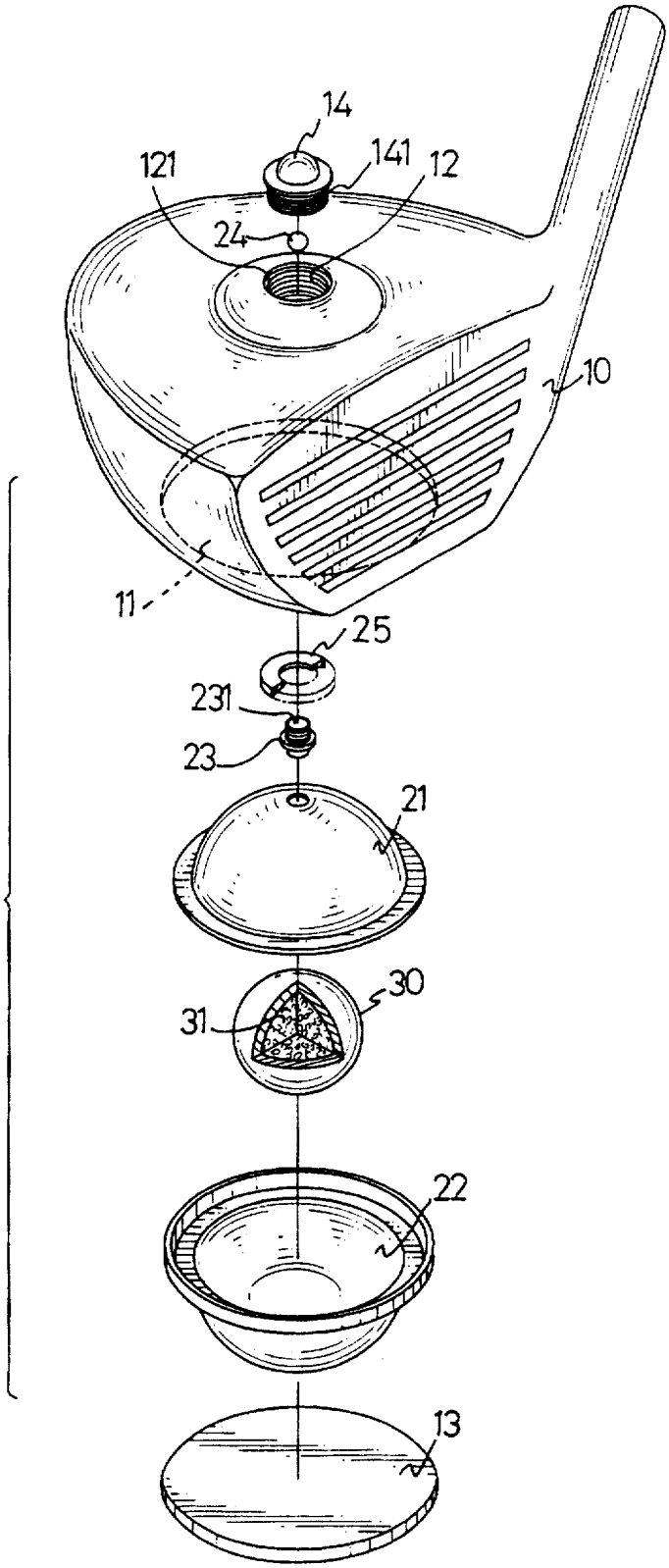
FIG. 1 is an exploded view showing a centroid-adjustable golf club head in accordance with the present invention.

Referring to FIG. 1, a centroid-adjustable golf club head in accordance with the present invention includes a head body 10, a sphericity composed of an upper casing 21 and a lower casing 22, and a floating ball 30 disposed between the upper casing 21 and the lower casing 22.

Figure 2A:
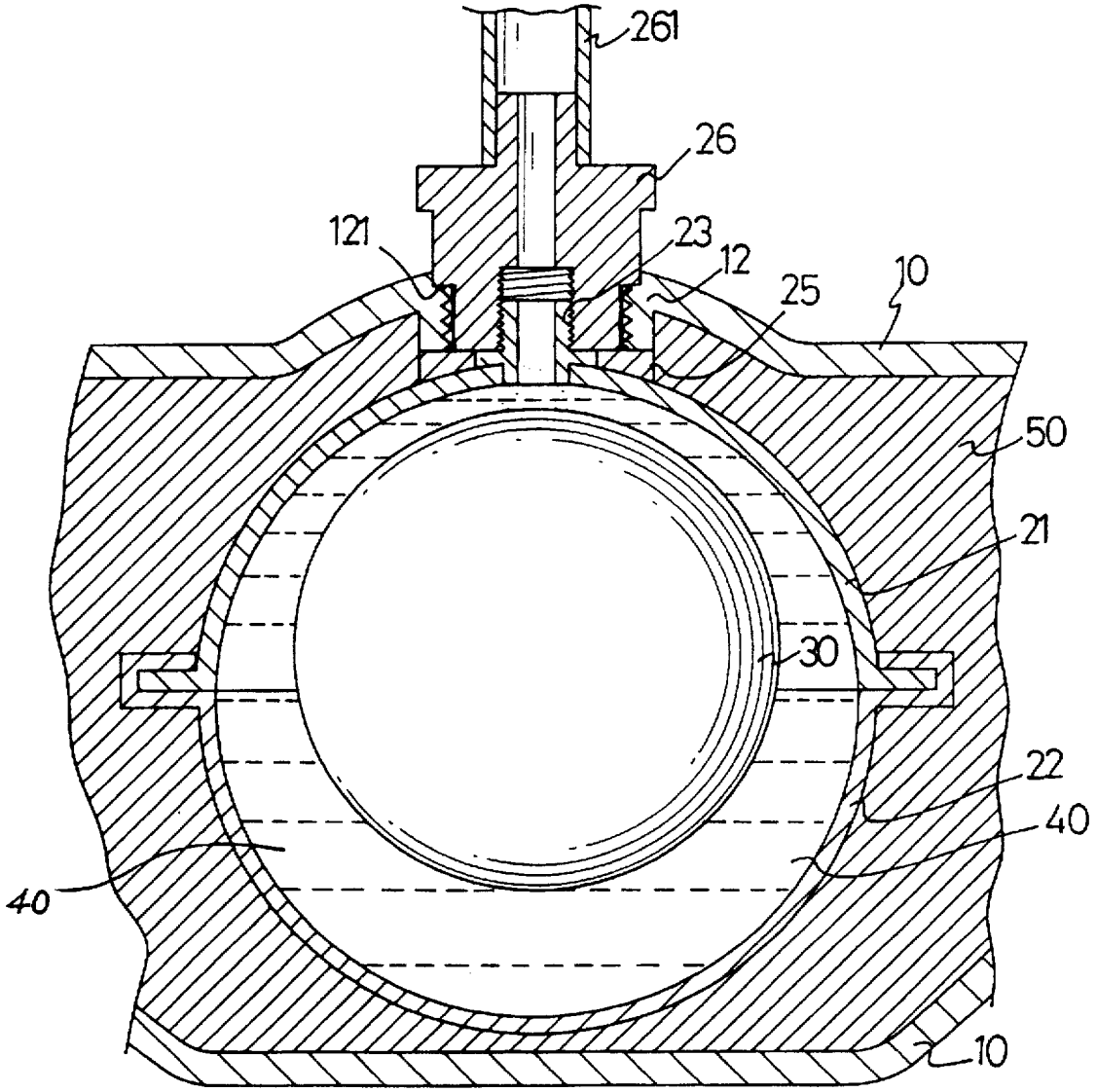
FIG. 2A and FIG. 2B are cross-sectional views showing a combined structure of the centroid-adjustable golf club head of FIG. 1.
Figure 2B:
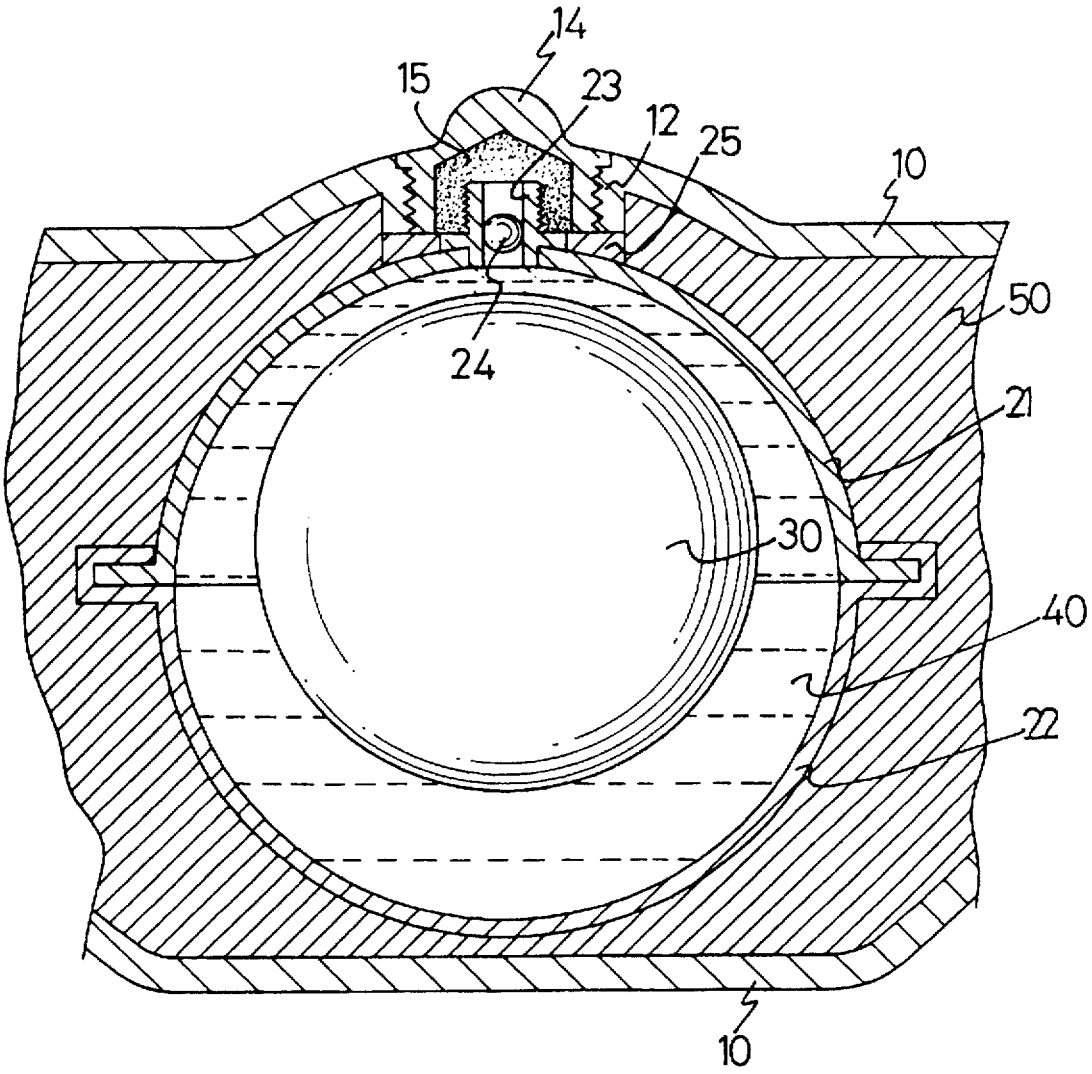

With reference to FIG. 2A and FIG. 2B, the head body 10 defines an opening 11 at a bottom thereof for the sphericity to be loaded therefrom. A kind of anti vibration and thermoplastic elastomer 50 (i.e., so-called VS-POLYMER) is then filled into the head body 10 to secure the sphericity after it expands. The head body 10 further defines a screw hole 12 at a top thereof and defines an opening 11 at a bottom thereof for the sphericity to be loaded into anti vibration and thermoplastic elastomer 50 therefrom. A circumferential recess 121 having a bigger diameter than that of the screw hole 12 is further defined on an upper face of the body 10 and aligned with the screw hole 12. The anti vibration and thermoplastic elastomer 50 is a copolymer which is cross linked by polystyrene phase and vinyl-polyisoprene phase. This copolymer material can be mixed with various plastic and adapted to be used in sports equipment, construction material, sole material, automotive material, enclosure of electrical appliance to improve resistance to impact and vibration capacity. When the VS-polymer is used in the golf club head, it can absorb most vibration energy generated by impact of the club head and the ball.

The floating ball 30 in the sphericity includes an outer layer of heat-resistant resin (or metal) enclosing a unicellular elastomer 31, which has high strength, wearability, heat endurance, and smooth surface.

The upper casing 21 of the sphericity has a charging spout 23 with male thread formed on a top thereof and aligned with the screw hole 12 of the head body 10. Also, an elastic wafer 25 is mounted on charging spout 23 of the upper casing 21 before the sphericity is loaded into the head body 10 from the opening 11. After the sphericity is disposed into the head body 10, a charging connector 26 with a screw hole (not numbered) and a charging pipe 261 is inserted into the screw hole 12 of the head body 10 and threadedly engaged with the charging spout 23. In this case, an outer wall of the charging connector 26 exactly abuts the circumferential recess 121 of the screw hole 12 to locate the sphericity temporarily. Then the opening 11 of the head body 10 IS sealed by welding a base plate 13. Thereafter, liquid 40 with a specific weight larger than that of the floating ball 30 is injected into the sphericity from the charging pipe 261 and the charging connector 26 so that the floating ball 30 can float in the liquid 40, as shown in FIG. 2A. Next, a steel ball 24 is filled into the charging spout 23 and a periphery of the charging spout 23 is sealed by seal gum 15 for water resistance. Finally, a cover 14 with male thread 141 is threaded into the screw hole 12. In this way, an improved golf club head is formed.

Figure 3:
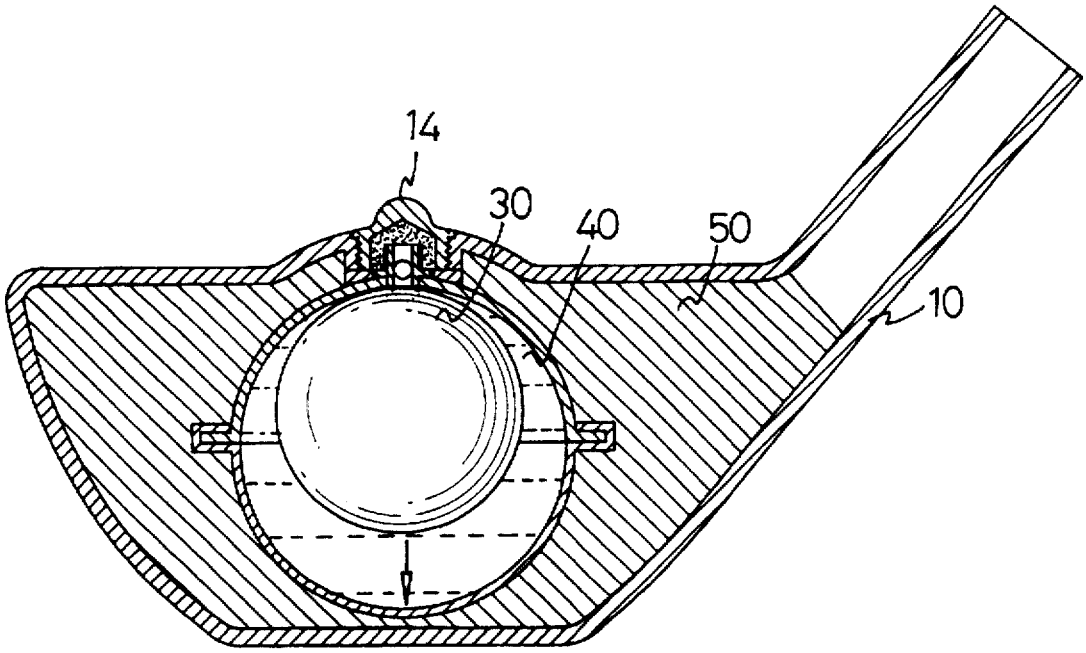
FIG. 3 through FIG. 6 are sectional schematic views respectively showing different statements of centroid of the centroid-adjustable golf club head when it is operated.

Referring to FIG. 3, when the club head is in a transverse quiescent condition, the floating ball 30 is located in an upper portion of the sphericity and the liquid 40 is deposited in an lower portion of the sphericity. Since the specific weight of liquid 40 is larger than that of the floating ball 30, the position of centroid of the club head is adjusted to the middle and lower portion of the sphericity with respect to the liquid 40. Therefore, a user can strike the ball more stably.

Figure 4:
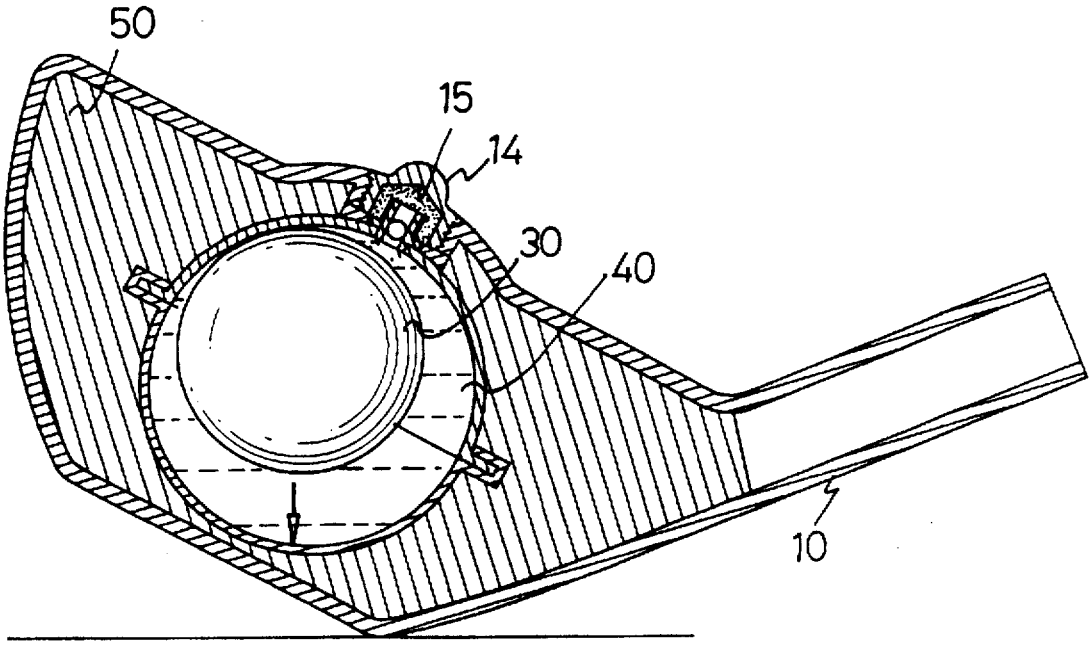
Figure 6:
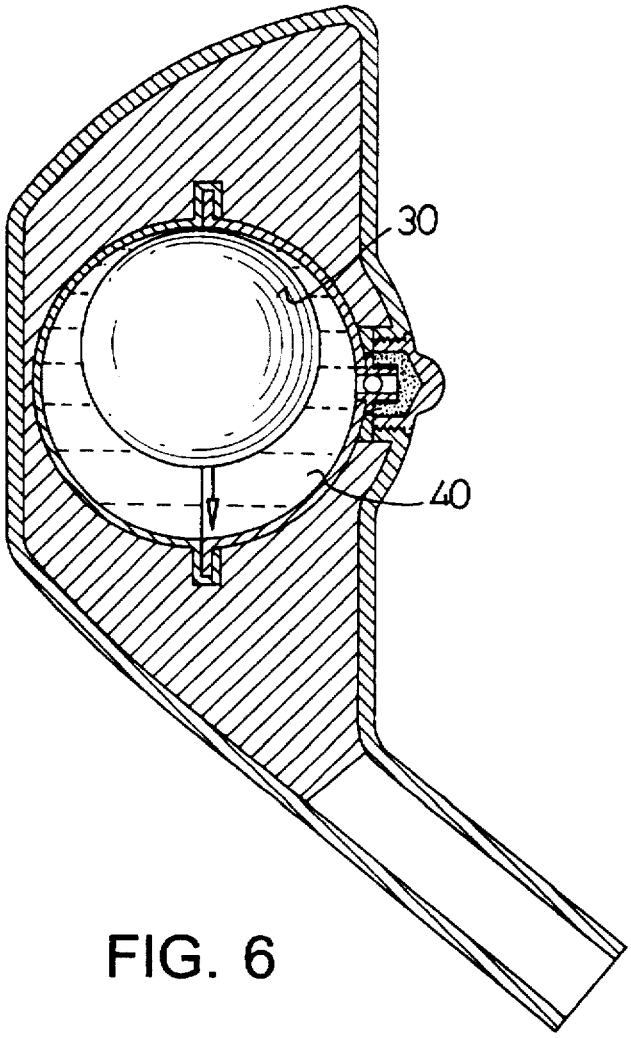
Figure 5:
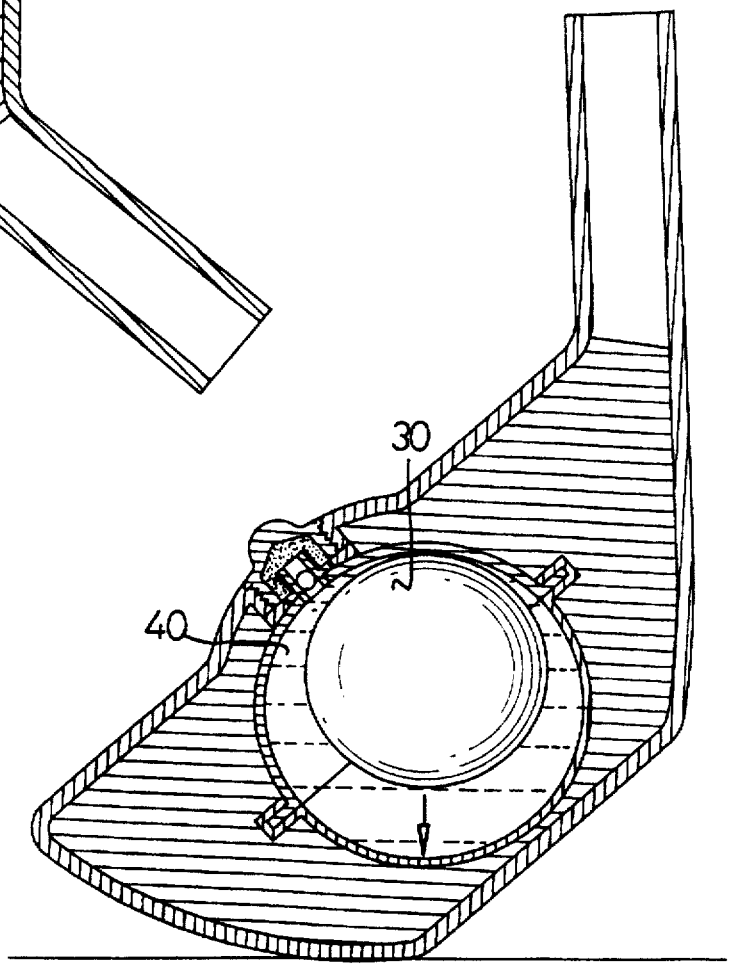

Further, when the user attempts to wield with the club to strike the ball from different angles, as shown in FIG. 4, FIG. 5 and FIG. 6, it can be seen that the liquid 40 is always deposited at a lower portion of the sphericity. With the same principle as FIG. 3, the centroids of the club head in FIG. 4, FIG. 5 and FIG. 6 will be respectively adjusted to an appropriate position, depending on the relative position of the liquid 40 and the floating ball 30. Therefore, an user can strike the ball stably at any time and in any angle.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A centroid-adjustable golf club head comprising:

a head body having an anti vibration and thermoplastic elastomer disposed therein and defining a screw hole at a top thereof;

a sphericity disposed in the anti vibration and thermoplastic elastomer of the head body, said sphericity having a charging spout formed on a top thereof and aligned with the screw hole of the head body; and an elastic wafer disposed between the head body and the sphericity;

a floating ball disposed in the sphericity;

a liquid with high specific weight fed from the charging spout to the sphericity.

2. A centroid-adjustable golf club head as claimed in claim 1, wherein said head body further has a cover threaded into the screw hole.

3. A centroid-adjustable golf club head as claimed in claim 1, wherein said sphericity further has a steel ball filled in the charging spout for use as a water-seal.

4. A centroid-adjustable golf club head as claimed in claim 1, wherein said charging spout is sealed by seal gum.

5. A centroid-adjustable golf club head as claimed in claim 1, wherein said floating ball has an outer layer of heat-resistant resin with high strength enclosing an anti vibration and thermoplastic elastomer therein.

* * * * *